US008113498B2

(12) United States Patent
Buerge

(10) Patent No.: US 8,113,498 B2
(45) Date of Patent: Feb. 14, 2012

(54) METHOD AND DEVICE FOR THE TRANSFER OF SIGNATURES

(75) Inventor: Marcel Buerge, Niedergoesgen (CH)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 12/856,115

(22) Filed: Aug. 13, 2010

(65) Prior Publication Data

US 2011/0036685 A1 Feb. 17, 2011

Related U.S. Application Data

(60) Provisional application No. 61/233,507, filed on Aug. 13, 2009.

(30) Foreign Application Priority Data

Aug. 13, 2009 (EP) ..... 09167800

(51) Int. Cl.
*B65H 5/32* (2006.01)

(52) U.S. Cl. ..... 270/52.29; 270/52.26; 270/52.14; 271/69; 198/644; 198/479.1

(58) Field of Classification Search ..... 270/52.26, 270/52.29, 52.14, 52.16, 52.19, 58.26, 58.29; 271/69; 198/644, 479.1, 478.1, 600
See application file for complete search history.

(56) References Cited

U.S. PATENT DOCUMENTS

| | | | | |
|---|---|---|---|---|
| 3,591,165 | A * | 7/1971 | McCahon et al. | 270/52.29 |
| 4,546,961 | A * | 10/1985 | Majewski et al. | 270/52.18 |
| 4,770,284 | A * | 9/1988 | Boss | 198/339.1 |
| 5,375,824 | A * | 12/1994 | Anker et al. | 270/52.29 |
| 5,615,871 | A * | 4/1997 | Kleinhen | 270/45 |
| 5,678,812 | A * | 10/1997 | Hartsoe | 270/52.16 |
| 6,270,068 | B1 * | 8/2001 | Cracknell | 270/52.26 |
| 6,315,107 | B1 | 11/2001 | Muller et al. | |
| 6,581,753 | B1 * | 6/2003 | Brewster et al. | 198/470.1 |
| 7,090,212 | B2 | 8/2006 | Hediger | |
| 2005/0082733 | A1 * | 4/2005 | Richter et al. | 270/52.26 |

FOREIGN PATENT DOCUMENTS

| | | |
|---|---|---|
| EP | 0 881 180 A1 | 12/1998 |
| EP | 0 916 514 A1 | 5/1999 |
| EP | 1 424 211 A1 | 6/2004 |
| JP | 8143179 A | 6/1996 |

OTHER PUBLICATIONS

European Search Report, dated Feb. 17, 2010, issued in European Application No. EP 09 16 7800.

* cited by examiner

*Primary Examiner* — Patrick Mackey

(74) *Attorney, Agent, or Firm* — Venable LLP; Robert Kinberg; Ryan M. Flandro

(57) ABSTRACT

A method and device for transferring signatures. The device includes a first gathering chain which conveys the signatures with the aid of pushers and which transfers the signatures in a transfer region to a second gathering chain. The second gathering chain includes at least one conveying chain provided with pushers that are arranged at a pre-defined distance relative to each other. The second gathering chain includes recesses adjacent to each of its pushers such that each pusher of the first gathering chain corresponds to a pusher of the second gathering chain and can be lowered through a respective recess.

21 Claims, 6 Drawing Sheets

METHOD AND DEVICE FOR THE TRANSFER OF SIGNATURES

CROSS-REFERENCE TO RELATED APPLICATION

This application claims the priority benefit of European Patent Application No. 09167800.3, filed on Aug. 13, 2009. This application also claims the priority benefit under 35 U.S.C. §119(e) of U.S. Provisional Patent Application No. 61/233,507, filed on Aug. 13, 2009. Each of the foregoing applications is expressly incorporated herein by reference in its entirety.

BACKGROUND OF THE INVENTION

1. Field of Invention

The invention relates to methods and devices for the transfer of signatures. In particular the invention relates to a device for the transfer of signatures in which a first and a second gathering chain have a joint transfer region for transferring the signatures. Respective conveying chains of the first and second gathering chains are arranged offset to the side and parallel to each other, at least in this transfer region. The first gathering chain is provided with a ridge as well as a number of pushers for moving the signatures that are positioned straddling on the ridge in a conveying direction and for transferring these signatures in the transfer region to the second gathering chain. The second gathering chain comprises at least one conveying chain with pushers arranged at a pre-defined distance to each other. The invention also relates to a method that can be realized with the aid of a device for the transfer of signatures. Further, the invention relates to a gathering and wire-stitching machine that includes a device for the transfer of signatures.

2. Related Art

During further processing, the signatures are conveyed, among other things, with the aid of so-called gathering chains which are typically used in gathering and wire-stitching machines. Gathering and wire-stitching machines are machines in which completely printed, folded signatures that are stored temporarily in feeders are gathered, are aligned and are subsequently provided with wire-stitching along the spine, for example, in a stitching machine. As a rule, the signatures are initially conveyed by a first, single gathering chain in the direction of the stitching machine. Even before reaching the stitching machine, the signatures are transferred from the first gathering chain to a second, dual gathering chain which then supplies the signatures to the stitching machine. The second gathering chain may also be embodied as a single gathering chain. An essential aspect of this type of further print material processing is that the signatures should be processed and/or transferred from one station to the next as carefully as possible. A number of devices and methods have already been developed to ensure that the signatures are transferred from a first to a second gathering chain in the most careful manner possible.

European patent document EP 0881180 A1 discloses a conveying system for gathering and processing signatures. The conveying system comprises a first, single and a second, dual gathering chain, as well as a transfer region where the single gathering chain enters the dual gathering chain. Pushers which are responsible for moving along the signatures are arranged on the single gathering chain. Each signature sits straddling on a ridge of the single gathering chain. To prevent an uncontrolled conveying of the signatures with non-defined spacing, relative to each other, a pusher is arranged behind each signature to ensure that it is conveyed in transporting direction. The pushers are mounted upright on the single gathering chain and are submerged in the transfer region while the dual gathering chain takes over the respective signature. As a result of the upright positioning, the pushers on the single gathering chain tilt in conveying direction while being submerged, thereby providing an additional push to the signatures. This can have the effect of leaving a mark in the back region of its signature fold.

European patent document EP 1424211 A1 discloses a device for producing bound printed products. The gathering chain comprises pushers arranged on the side. At the end of the gathering chain, the signatures are transported via a support plate to an intermediate conveying region from which they are supplied with the aid of an intermediate conveyor and via a sword to a stitching line. The stitching line in this case corresponds to the above-mentioned dual gathering chain. This solution has the disadvantage of using additional elements in the intermediate conveying region, for example the support plate, which results in making the system more expensive.

SUMMARY

It is an object of the invention to provide a device and a method for realizing the transfer of the signatures or printed sheets from the first to the second gathering chain in a careful as well as a cost-saving manner.

The above and other objects are achieved according to the invention wherein there is provided, in one embodiment, a device for the transfer of signatures, comprising: a first gathering chain and a second gathering chain, wherein the first and second gathering chains are configured to convey the signatures in a conveying direction and together define a transfer region for the signatures, wherein the first gathering chain includes: a first conveying chain; a ridge coupled to the first conveying chain; and a number of first pushers positioned along each side of the ridge, the first pushers configured to convey the signatures in the conveying direction and transfer the signatures in the transfer region to the second gathering chain, and wherein the second gathering chain comprises: at least one second conveying chain, wherein the first and second conveying chains are arranged parallel to each other and offset transverse to the conveying direction from one another, at least in the transfer region; and a number of second pushers arranged at a pre-defined distance relative to each other along the at least one second conveying chain, wherein a recess is defined adjacent to each second pusher so that each first pusher of the first gathering chain can be submerged through the respective recess in the transfer region.

Thus, according to one aspect of the invention, the second gathering chain is provided in the region of its pushers with a recess which is designed so that each pusher from the first gathering chain that is assigned to a pusher of the second gathering chain can be submerged through the respective recess. In the process, each pusher of the first gathering chain is submerged in the transfer region while each pusher of the second gathering chain emerges.

In an embodiment of the invention, the first gathering chain conveys the signatures, positioned straddling on a ridge, with the aid of its pushers to the joint transfer region for both gathering chains and then transfers the signatures in this region to the respectively associated pushers of the second gathering chain.

The second gathering chain may comprise support elements which are attached to the at least one conveying chain on the side that is facing away from the first gathering chain.

The recess is incorporated into the support elements in the conveying direction either in front of or after the pushers of the second gathering chain or is formed by omitting at least one support element of the second gathering chain either in front of or after the pushers of the second gathering chain. Each pusher of the first gathering chain is assigned to a pusher of the second gathering chain in such a way that the pushers of the first gathering chain can be submerged through the respective recesses in the support elements of the second gathering chain.

According to another aspect of the invention there is provided a method for transferring signatures, comprising utilizing the above described device.

According to another embodiment of the method according the invention, each first pusher of the first gathering chain is submerged in the transfer region, and each second pusher of the second gathering chain emerges in the transfer region, wherein each of the first pushers of the first gathering chain is moved through the respective recess arranged in the second gathering chain.

In another embodiment of the invention, the device is intended for use in a gathering and wire-stitching machine.

In still another embodiment of the invention, the method and the device for realizing the method provide the option of transferring the signatures in a careful manner from the first to the second gathering chain.

The device according to the invention makes it possible to omit several elements. For example, the support wheel and the intermediate conveyor disclosed in the document EP 1424211 A1 are no longer needed. As a result, the costs for producing and maintaining the device are reduced.

BRIEF DESCRIPTION OF THE DRAWINGS

These and other features and advantages of the invention will be further understood from the following detailed description of an embodiment with reference to the accompanying drawings, in which the same reference numbers are used throughout the Figures for structurally and/or functionally identical components and in which.

DETAILED DESCRIPTION

Figure 1:
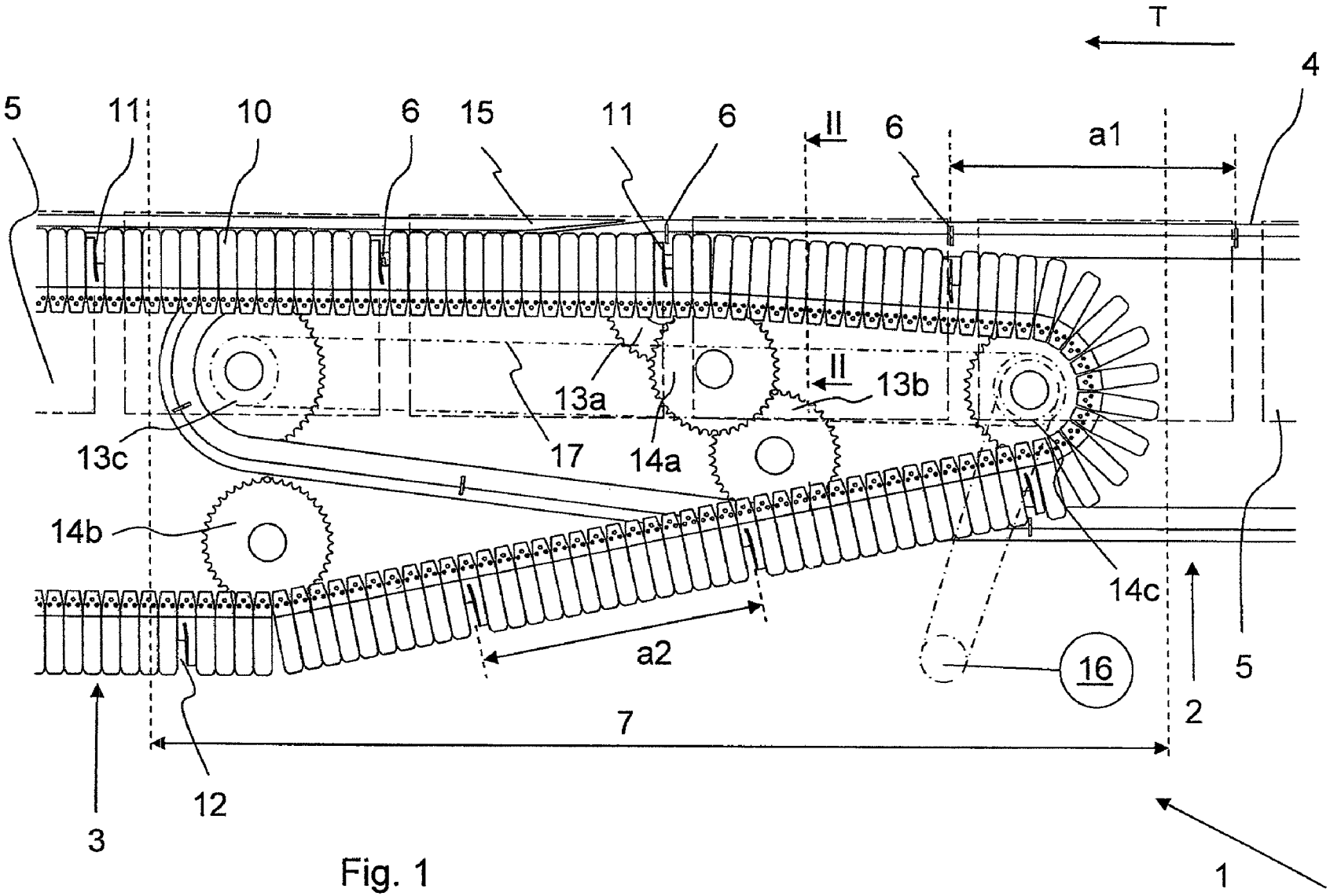
FIG. 1 depicts a side view a device according to an embodiment of the invention.
Figure 2:
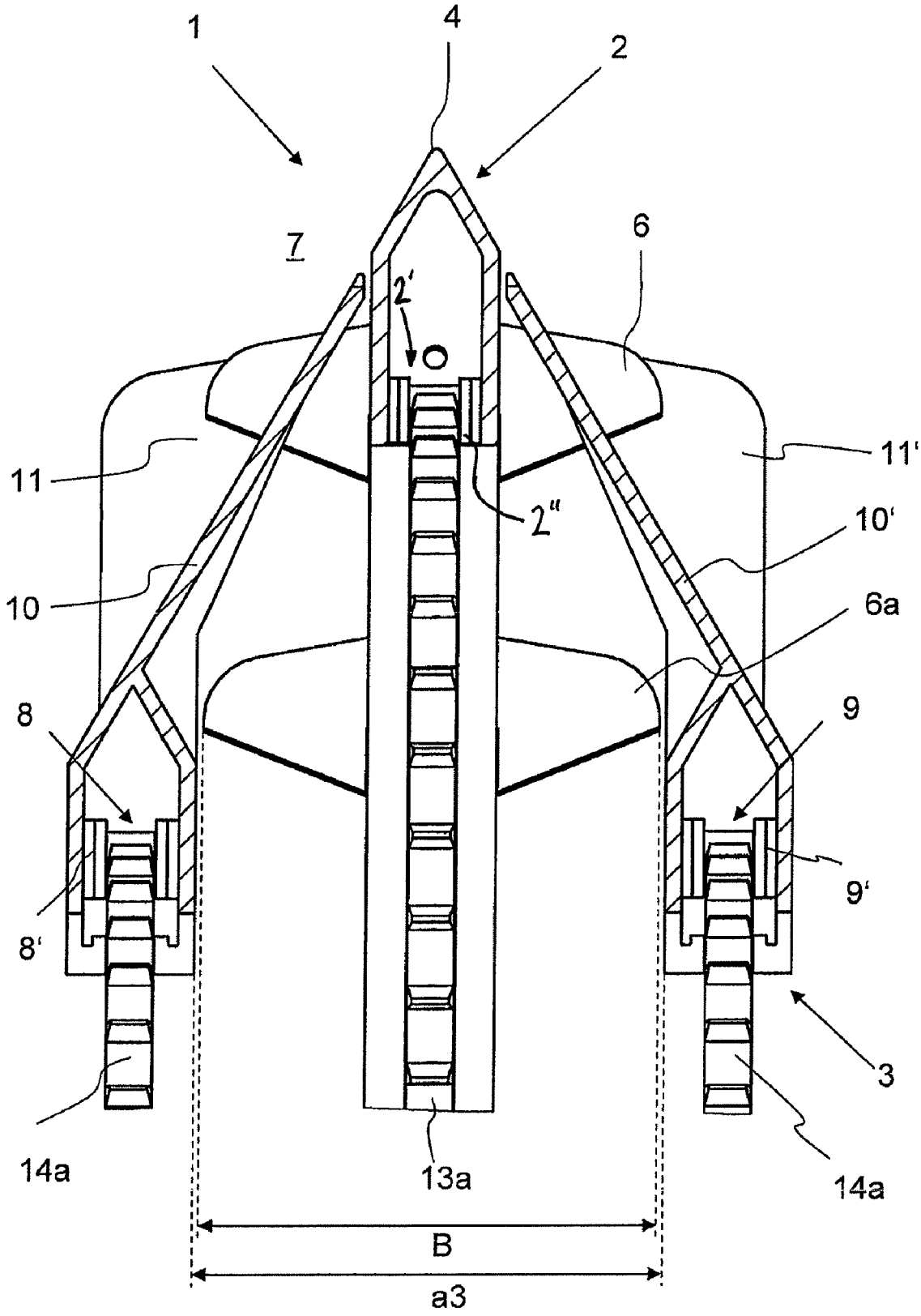
FIG. 2 depicts a section through the transfer region for the device, along the line II-II in FIG. 1.

FIG. 1 shows a side view of a device 1 according to an embodiment of the invention which forms a component of a gathering and wire-stitching machine that is not shown in further detail herein and is provided with a number of feeders and a stitching machine. The device 1 comprises a first, single and a second, dual gathering chain 2, 3. The first, single gathering chain 2, which is shown only schematically for reasons of a better overview, includes a first conveying chain 2' with chain links 2" and conveys the signatures 5, positioned straddling on its ridge 4, in a conveying direction T with the aid of a number of pushers 6. The pushers 6 are arranged distributed with a spacing a1 along the first gathering chain 2. The first gathering chain 2 enters the second gathering chain 3 in a transfer (transition) region 7, shown with perpendicular, dashed lines. In this transfer region 7, the signatures 5 are transferred from the first gathering chain 2 to the second gathering chain 3. The second gathering chain 3 comprises second and third conveying chains 8, 9 with chain links 8', 9' with thereon arranged support elements 10, 10' for the signatures 5 (FIG. 2). Specific support elements 10, 10' are provided with pushers 11, 11' of the second gathering chain 3, wherein these specific support elements 10, 10' can be embodied correspondingly. Alternatively, the support elements 10, 10' can also be embodied as pushers 11, 11'. The pushers 11, 11' are arranged opposite each other in pairs on the second and on the third conveying chain 8, 9 of the second gathering chain 3 and are distributed along the conveying chains 8, 9 with a pre-defined spacing a2 relative to each other.

The support elements 10, 10' of the second gathering chain 3 are provided in the region of each pair of pushers 11, 11' and in conveying direction T either before or after this pair of pushers 11, 11' with a recess 12 through which respectively one pusher 6 of the first gathering chain 2 is submerged during the operation of the device 1. Alternatively, the recess 12 can also be formed by omitting at least one support element 10, 10' of the second gathering chain 3, either before or after this pusher pair 11, 11'.

Being submerged describes a movement that is carried out by the pusher 6 as soon as the first conveying chain 2' leaves the conveying direction T of the signatures 5 and follows a first deflection element 13*a* of the first gathering chain 2, which is attached rotating on a machine frame, not shown, of the device 1. Prior to each submerging movement of a pusher 6 of the first gathering chain 2, a pair of pushers 11, 11' of the second gathering chain 3 emerges. The emerging pushers 11, 11' in this case follow a first deflection element 14*a* of the second gathering chain 3 which is also attached rotating to a machine frame, not shown herein, of the device 1. The first and second gathering chains 2, 3, respectively, comprise a second deflection element 13*b*, 14*b* which is also attached rotating on the machine frame for the device 1 and functions to ensure a quiet guidance of the associated gathering chain.

The first and the second gathering chains 2, 3 are arranged in such a way that the signatures 5 are transferred to the second gathering chain 3 before the pusher 6 of the first gathering chain 2 that conveys the signatures 5 is submerged. The signatures are thus essentially conveyed in the same conveying direction T in the transfer region 7 to ensure the most careful a transfer of the signatures 5 that is possible. Following the transfer and during the further conveying, the signatures 5 are supported from below by a sword 15, arranged on a machine frame of the device 1 which is not shown herein. The sword 15 is arranged above the second gathering chain 3, between its conveying chains 8, 9, and projects in upward direction up to the level of the ridge 4 of the first gathering chain 2. Markings on the signatures and/or damages to the signatures 5 can be avoided as a result of these measures.

At least one drive unit is provided for both gathering chains 2, 3. According to an embodiment of the inventive device 1, a single drive unit 16 is used for the first and the second gathering chain 2, 3 which drives the chain via a mechanical connection 17, for example a chain. Alternatively, a different element such as, for example, a toothed belt, which ensures the synchronized movement of the two gathering chains 2, 3, can also be used. The advantage of using a single drive unit 16 is that it saves costs and furthermore allows an easy synchronizing of the two gathering chains 2, 3.

According to another embodiment of the inventive device 1, a separate drive unit, not shown herein, is used for the first and the second gathering chain 2, 3.

The first and the second gathering chain 2, 3 are embodied as endlessly circulating chains and, in the manner of a typical endlessly circulating belt, comprise additional deflection elements 13*c*, 14*c* which are arranged at the two ends. For drawing reasons, the Figures only show the additional deflection elements 13*c*, 14*c* arranged in the transfer region 7, meaning a deflection element 13*c* at the downstream end of the first gathering chain 2 and a deflection element 14*c* at the upstream end of the second gathering chain 3. The deflection elements 13*a*, 13*b*, 13*c* of the first gathering chain 2 as well as the deflection elements 14*a*, 14*b*, 14*c* of the second gathering chain 3 can take the form of a chain wheel, a deflection roll or the like. In the same way, fixed deflection elements such as reversing cams can also be used.

For the embodiment shown herein, the first, second, and third conveying chains 2', 8, and 9 of the two gathering chains 2, 3 have identical chain divisions in conveying direction T and are driven with identical speeds. According to an alternative embodiment, not shown herein, the gathering chains 2, 3 each have a different chain division of 14 and/or 15 inches, for example, and are operated with correspondingly adapted speeds. The two alternative embodiments make it possible to adapt the device 1 to different standards of further print processing machines.

The first and the second gathering chains 2, 3 are respectively driven in conveying direction T with a chain speed that ensures that the frequencies for the submerging and/or emerging of the pushers 6, 11, 11' are identical. This is based on the requirement that the pusher 6 of the first gathering chain 2 can be submerged only if the recess in the support elements 10, 10' is in a corresponding position in the region of the associated pusher pair 11, 11' of the second gathering chain 3.

FIG. 2 shows a sectional view along the line II-II through the transfer region 7 for the device 1 in FIG. 1. The viewing direction in this case is in the conveying direction T. A pusher 6 with a wing-shaped design is arranged below the ridge 4 of the first gathering chain 2, such that it projects on both sides. In this view, the pusher 6 of the first gathering chain 2 is submerged in front of the pusher pair 11, 11' of the second gathering chain 3, meaning behind the pair as seen in conveying direction T. A different pusher 6*a* of the first gathering chain 2, which has already been submerged, is arranged upstream of the pusher 6 in conveying direction T. The pusher 6*a* in the process of being submerged initially follows the curvature of the deflection element 13*a*. Subsequently, it moves in a straight line and is then deflected at the additional deflection element 13*c* of the first gathering chain 2, shown in FIG. 1, such that it moves essentially in opposite direction of the conveying direction T. For this embodiment of the device 1, the first gathering chain 2 is deflected downward at an angle by the deflection element 13*a* before being deflected by the deflection element 13*c* to move essentially in a direction counter to the conveying direction T. The deflection of the first gathering chain 2 contributes to improving the careful transfer of the signatures 5. The reasons for this are obvious from the explanations below that relate to the chain speed, in connection with FIG. 4. Subsequently, the first gathering chain 2 along with the attached pushers 6 is again deflected with the aid of the deflection element 13*b*, also shown in FIG. 1, and finally with the deflection element 13*c* that is arranged at the upstream end of the first gathering chain 2, so that respectively one pusher 6 is available there for the transport of the following printed sheet 5.

According to another embodiment of the device 1, which is not shown herein, the first deflection element 13*a* is identical to the additional deflection element 13*c*, arranged at the downstream end of the first gathering chain 2.

The first gathering chain 2 is submerged the area between the first and the second conveying chain 8, 9 of the second gathering chain 3. A spacing a3 between the first and the second conveying chains 8, 9 in this case is larger by a predefined safety distance than a width B, extending transverse to the conveying direction T, of the pushers 6 on the first gathering chain 2, wherein the width B is respectively defined by the distance between the outer end on both sides of the pusher 6. Depending on the arrangement of the recess 12 for the device 1 according to an embodiment of the invention, two options exist for the pusher 6 to be submerged, in conveying direction T either behind or in front of the pusher pair 11, 11', wherein the first option is illustrated in FIG. 2.

Figure 3:
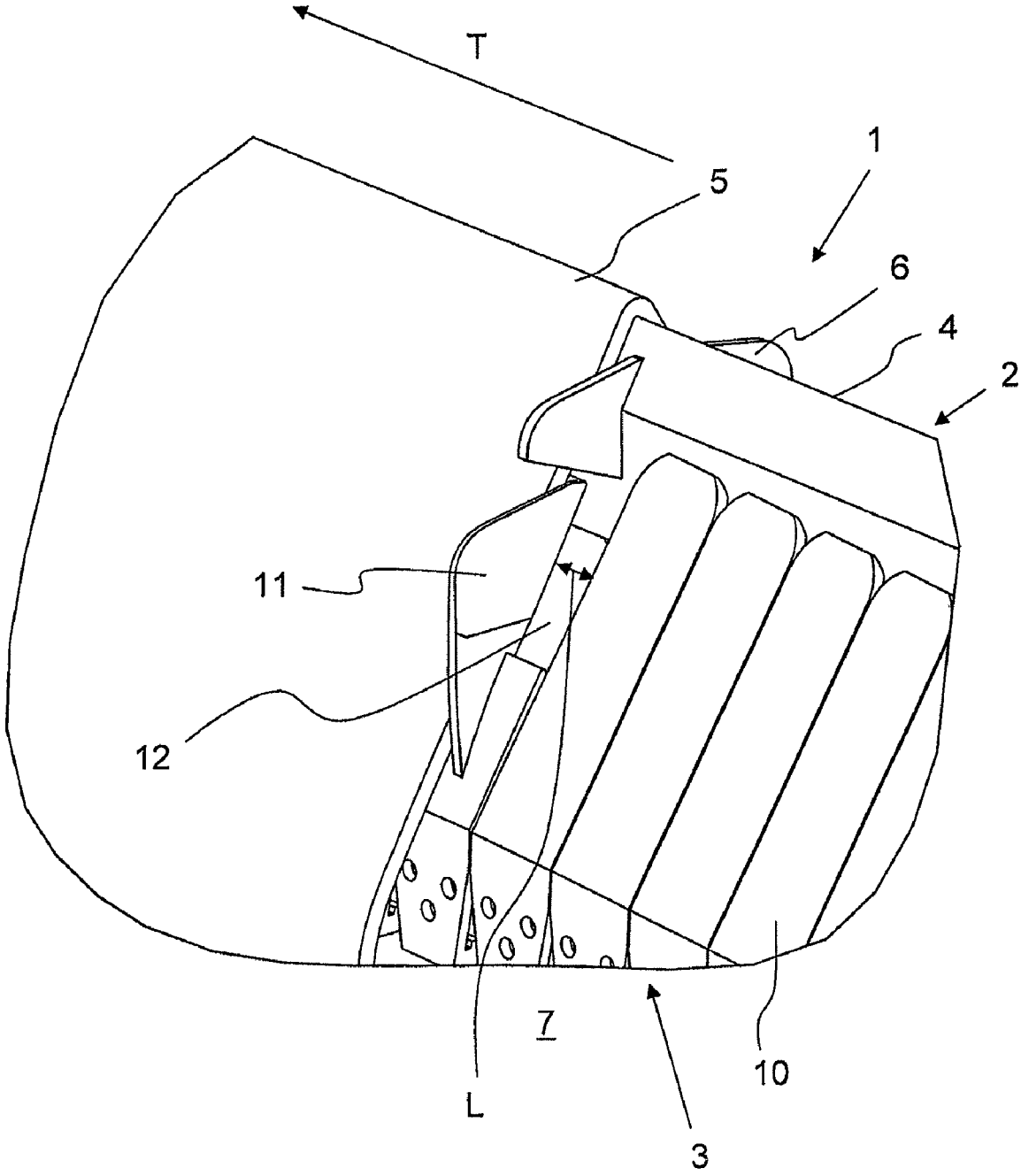
FIG. 3 depicts a first detailed view of the transfer region at a first point in time.
Figure 4:
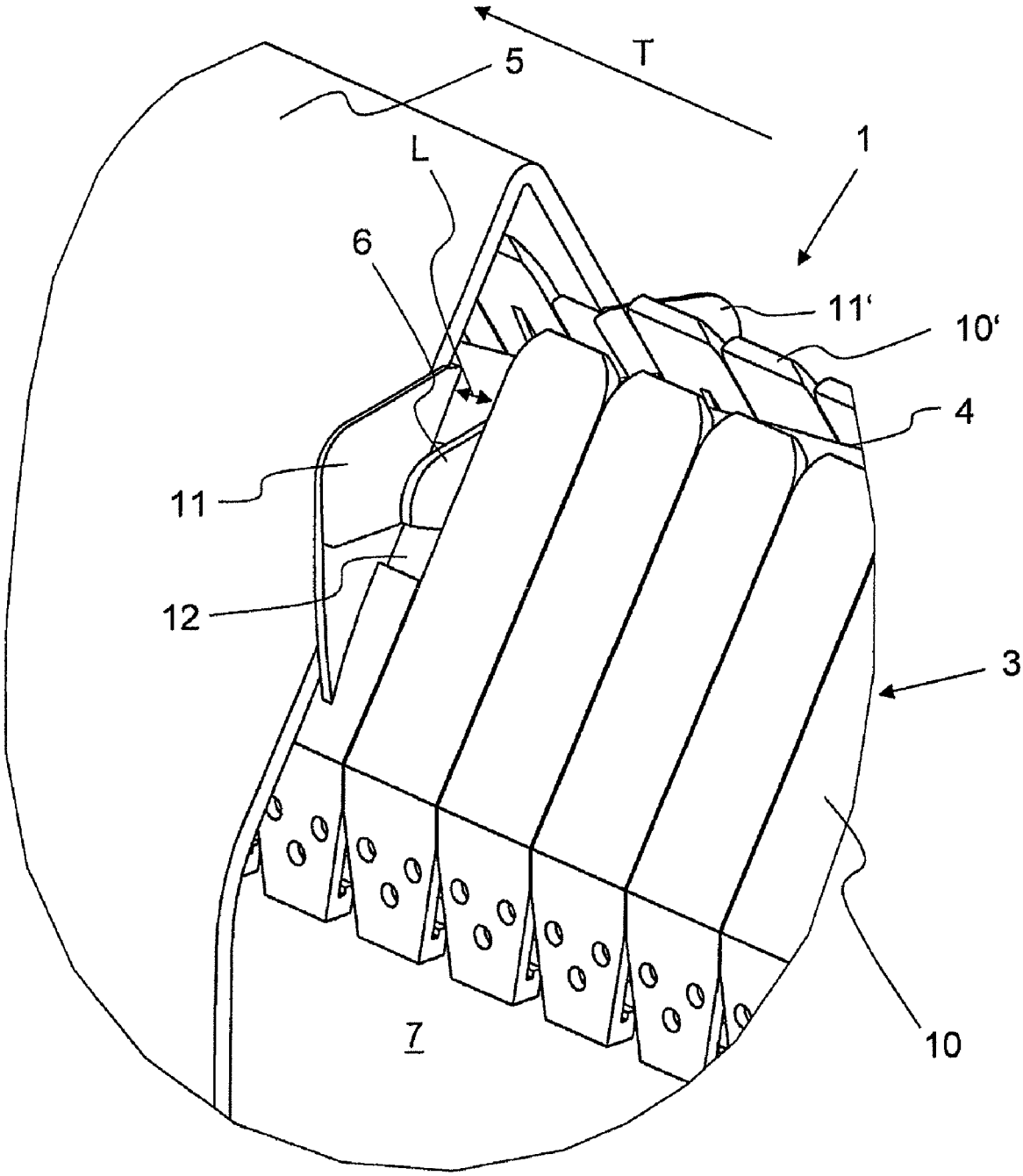
FIG. 4 depicts a second detailed view of the transfer region at a second point in time.

FIG. 3 and FIG. 4 show a first and/or a second detailed view of the device 1 according to an embodiment of the invention in the transition region 7. These views represent snapshots before and during the submerging of a pusher 6 on the first gathering chain 2, wherein the first option also shows the sequence for the submerging, meaning the submerging upstream of the pair of associated pushers 11, 11' on the second gathering chain 3.

In FIG. 3, the pusher 6 is still moving in conveying direction T and is conveying a signature 5. The pair of pushers 11, 11' of the second gathering chain 3 emerges in the transition region 7 and takes over the signature 5 from the pusher 6 of the first gathering chain 2. In the process, the pusher pair 11, 11' essentially moves in conveying direction T during the transfer operation. In other words, FIG. 3 represents the instant at which the signature is transferred from the first to the second gathering chain 2, 3.

At the point in time shown in FIG. 4, the pusher 6 of the first gathering chain 2 is in the process of moving downward through the recess 12, along the deflection element 13*a* that is not shown herein, meaning in conveying direction T behind the pushers 11, 11' of the second gathering chain 3. The pushers 11, 11' have already taken over the signature 5 and continue to move this signature on the second gathering chain 3 in conveying direction T. The recess 12 has a length L, extending in conveying direction T, which is selected such that the pusher 6 of the first gathering chain 2 can be submerged completely without hitting the support element 10, 10' which follows the recess 12.

Observing the appropriate length L for the recess 12 is also necessary because of a speed vector of the pusher 6. During the pusher movement in conveying direction T, its speed vector points in the same direction. However, as soon as the pusher 6 of the first gathering chain 2 moves downward to be submerged, its speed vector is composed of a component in conveying direction and a downward-directed component perpendicular to the conveying direction T. It means that the speed of the first gathering chain 2 and thus also the speed of the pusher 6 in conveying direction T is reduced by the downward-pointing speed component. The situation is reversed for the second gathering chain 3 and/or its pair of pushers 11, 11'. Owing to the fact that the second gathering chain 3 emerges, the speed component in the conveying direction T increases for each respectively emerging pusher pair 11, 11' that is attached to the second gathering chain 3. It can be concluded from this that the change in the speed vectors during the submerging of the pusher 6 on the first gathering chain 2 and the emerging of the pusher pair 11, 11' on the second gathering chain 3 are taken into consideration when dimensioning the recess 12.

Figure 5:
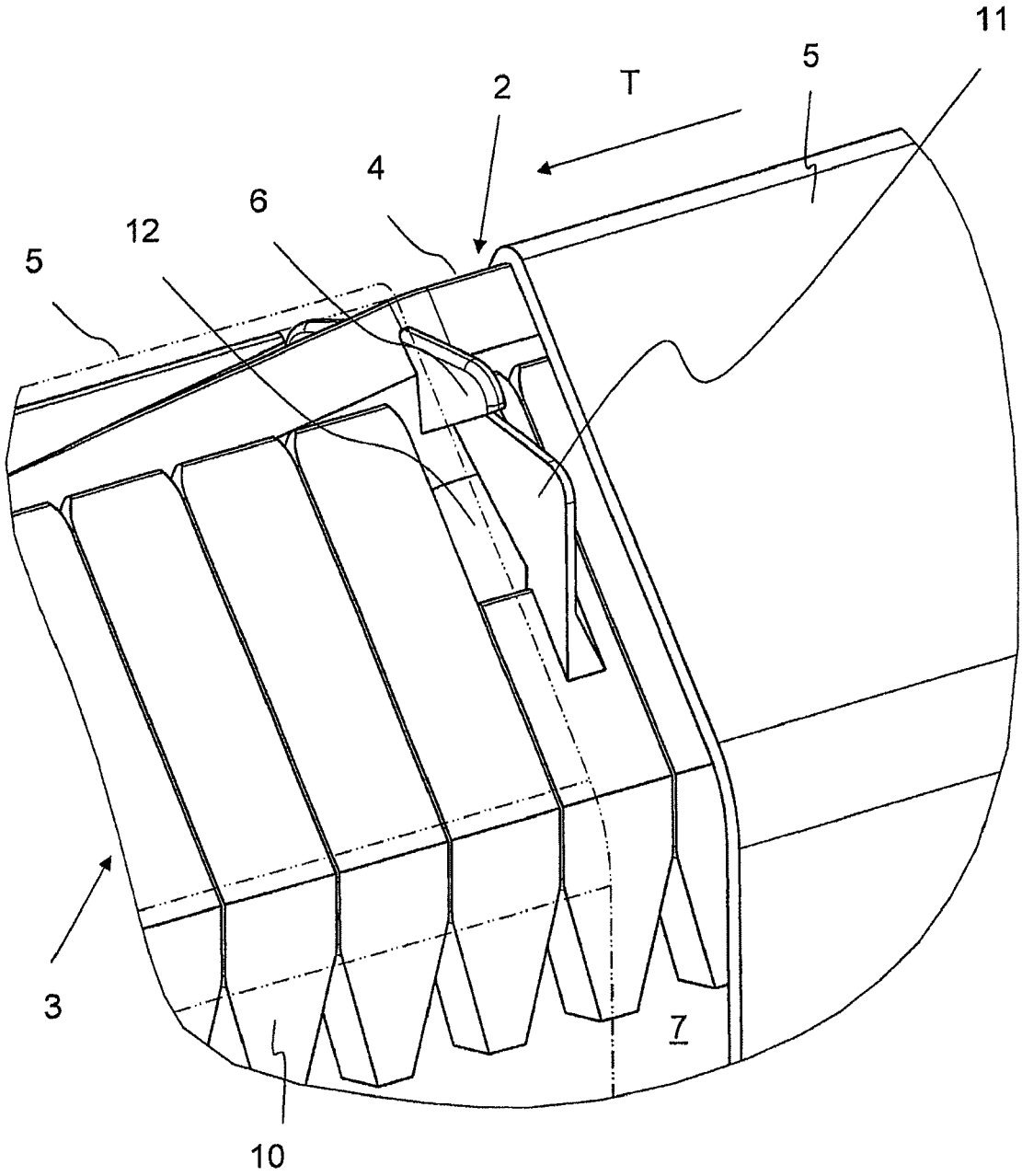
FIG. 5 depicts a further detailed view of the transfer region for the device showing an alternative embodiment as compared to FIGS. 3 and 4.

FIG. 5 illustrates the second option in the sequence in which each pusher 6 of the first gathering chain 2 is submerged in conveying direction T in front of the associated pusher pair 11, 11' of the second gathering chain 3, meaning downstream of these pushers 11, 11'.

Figure 6:
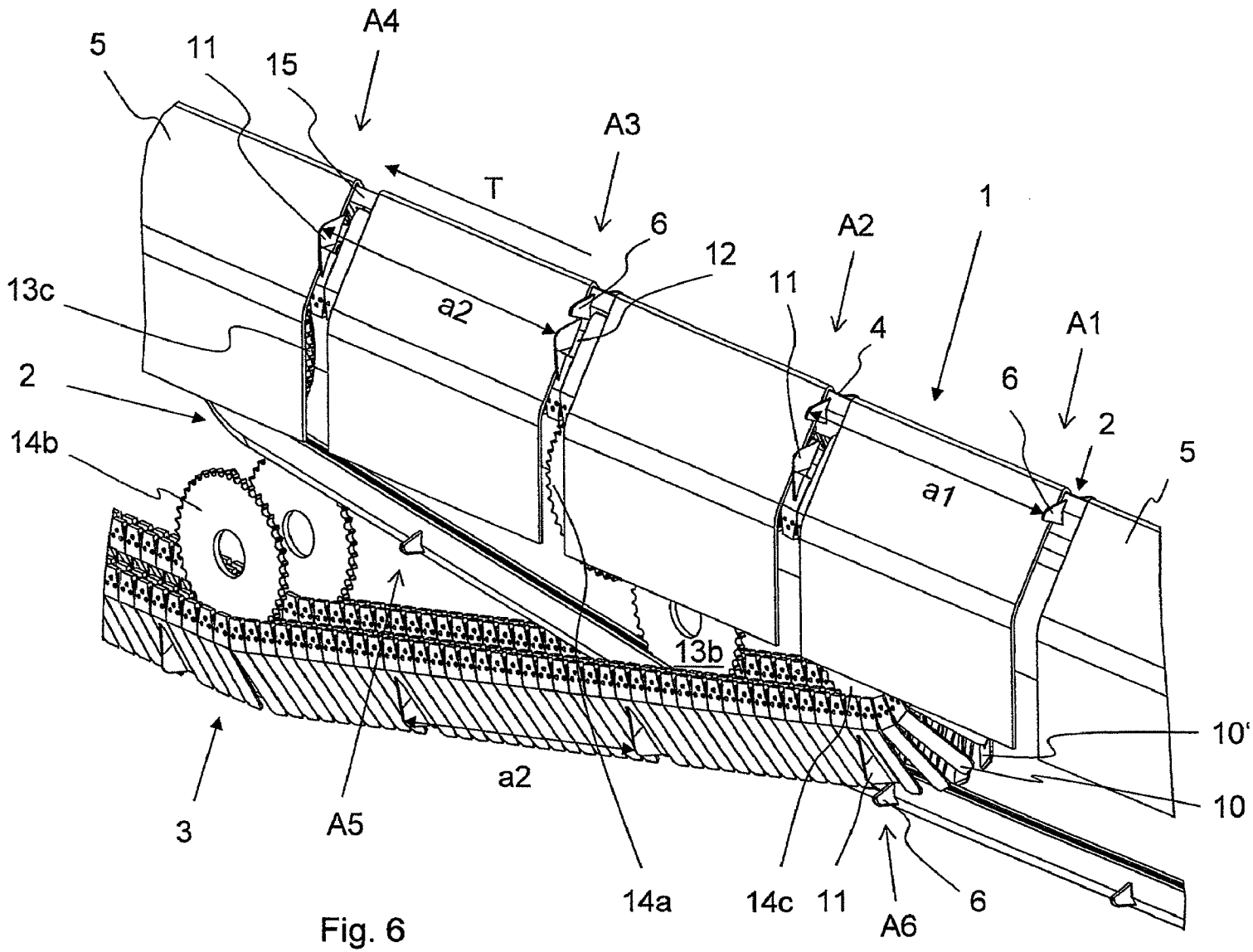
FIG. 6 depicts a side view, seen at an angle, of the device according to an embodiment of the invention.

FIG. 6 depicts a side view, seen at an angle, of the device 1 according to an embodiment of the invention which shows in particular six snapshots A1, A2, A3, A4, A5 and A6 of the position of a pusher 6 on the first gathering chain 2 with the aid of the associated arrows.

In a first snapshot A1, the pusher 6 conveys the signature 5 that is positioned straddling on the first gathering chain 2 in conveying direction T.

In a second snapshot A2, the pusher 6 is already located in the transition region 7, not shown herein, in which an emerging pusher pair 11, 11' of the second gathering chain 3 approaches the pusher 6 of the first gathering chain 2.

In a third snapshot A3, the pusher 6 is at the point of moving downward at the first reversing element 13*a* of the first gathering chain 2, not visible herein, while the pusher pair 11, 11' of the second gathering chain 3 has emerged completely.

In a fourth snapshot A4, the pusher 6 of the first gathering chain 2 is submerged completely through the recess 12 and into the second gathering chain 3 and has already transferred the signature 5 to the pusher pair 11, 11' of the second gathering chain 3 which essentially moves in conveying direction T.

In a fifth snapshot A5, the pusher 6 moves essentially in a direction counter to the conveying direction T, following the deflection by the additional deflection element 13*c* of the first gathering chain 2.

In a sixth snapshot A6, the pusher 6 of the first gathering chain 2 has just passed the recess 12, not visible, of the support elements 10, 10' of the second gathering chain 3, in the region of an associated, emerging pusher pair 11, 11' of the second gathering chain 3. Following this, the pusher 6 is returned to the starting point where it is again available for transporting a signature 5.

To ensure synchronization during the first as well as the second passing of the recess 12, several parameters of the device 1 according to an embodiment of the invention must be coordinated with each other. Essentially, these parameters involve the division and the speed as well as the length of overlap for the two gathering chains 2, 3.

Of course, instead of being embodied as dual gathering chain with two conveying chains 8, 9, the second gathering chain 3 can also be embodied as a single gathering chain with a single conveying chain 8 which is arranged offset to the side and parallel to the first conveying chain 2' of the first gathering chain 2, at least in the transfer region 7, wherein this is also shown in FIG. 1. In that case, the first gathering chain 2 does not move into the second gathering chain 3, but extends beside the second gathering chain 3 and parallel thereto in the transfer region 7.

Even though advantageous embodiments of the invention are shown and described herein, the invention is not limited to these examples, but can also be embodied and used in different ways within the scope of validity of the claims following below.

What is claimed is:

1. A device for the transfer of signatures, comprising:

a first gathering chain and a second gathering chain, wherein the first and second gathering chains are configured to convey the signatures in a conveying direction and together define a transfer region for the signatures, wherein the first gathering chain includes:

a first conveying chain;

a ridge coupled to the first conveying chain; and a number of first pushers positioned along each side of the ridge, the first pushers configured to convey the signatures in the conveying direction and transfer the signatures in the transfer region to the second gathering chain, and wherein the second gathering chain comprises:

at least one second conveying chain, wherein the first and second conveying chains are arranged parallel to each other and offset transverse to the conveying direction from one another, at least in the transfer region; and a number of second pushers arranged at a pre-defined distance relative to each other along the at least one second conveying chain, wherein a recess is defined adjacent to each second pusher so that each first pusher of the first gathering chain can be submerged through the respective recess in the transfer region.

2. The device according to claim 1, wherein the first pushers of the first gathering chain project outwardly from both sides of the first gathering chain.

3. The device according to claim 1, wherein the second gathering chain further comprises:

support elements attached to the at least one second conveying chain on a side facing away from the first gathering chain, wherein each recess is located in the support elements either before or after each second pusher of the second gathering chain, as seen in the conveying direction.

4. The device according to claim 1, wherein the second gathering chain further comprises:

support elements attached to the at least one second conveying chain on a side facing away from the first gathering chain, wherein each recess is formed by omitting at least one support element of the second gathering chain, either before or after each second pusher of the second gathering chain, as seen in the conveying direction.

5. The device according to claim 1, wherein the second gathering chain comprises second and third conveying chains arranged at a distance to each other transverse to the conveying direction, and wherein the first conveying chain of the first gathering chain is arranged between the second and third conveying chains at least in the transfer region.

6. The device according to claim 5, wherein the second pushers of the second gathering chain are arranged in pairs opposite each other on the second and third conveying chains.

7. The device according to claim 1, wherein the first and the second gathering chains are arranged so that the signatures are conveyed in the transfer region in essentially the same conveying direction.

8. The device according to claim 1, wherein the first and the second gathering chains are jointly driven by at least one drive.

9. The device according to claim 8, further comprising a mechanical connection coupled between the at least one drive and one of the first and second gathering chains.

10. The device according to claim 1, wherein the first and second gathering chains have the same or a different division.

11. A method for transferring signatures, comprising:

utilizing the device of claim 1.

12. A method for transferring signatures using a device, the device including a first gathering chain and a second gathering chain defining a transfer region wherein the first gathering chain includes a first conveying chain, a ridge coupled to the first conveying chain, and a number of first pushers positioned along each side of the ridge, and wherein the second gathering chain includes a second conveying chain arranged parallel to the first conveying chain in the transfer region, a number of second pushers arranged at a pre-defined distance relative to each other along the second conveying chain, and a recess defined adjacent to each second pusher, the method comprising:

conveying the signatures in a conveying direction with the first pushers;

submerging each first pusher of the first gathering chain in the transfer region; and emerging each second pusher of the second gathering chain in the transfer region, wherein each of the first pushers of the first gathering chain is moved through the respective recess arranged in the second gathering chain.

13. The method according to claim 12, further comprising:

transferring the signatures from the first pushers of the first gathering chain to the associated second pushers of the second gathering chain once the first pushers are submerged into the respective recess behind the second pushers as seen in the conveying direction.

14. The method according to claim 12, wherein each first pusher of the first gathering chain is submerged into the respective recess in front of each second pusher of the second gathering chain as seen in the conveying direction, and wherein, prior to being submerged, each first pusher transfers each respective signature to the second gathering chain.

15. The method according to claim 12, further comprising conveying the signatures with the first and second gathering chains in the transfer region at a clocking speed.

16. The method according to claim 15, wherein, when a division of each of the first and second gathering chains is the same, the signatures are conveyed with the first and second gathering chains at the same clocking speed throughout the transfer region.

17. The method according to claim 15, wherein, when a division of each of the first and second gathering chains is different, the signatures are conveyed with the first and second gathering chains at different clocking speeds throughout the transfer region.

18. The method according to claim 12, wherein the second pushers of the second gathering chain emerge in the transfer region and, while moving essentially in conveying direction, take over the conveying of the signatures from the first pushers of the first gathering chain.

19. The method according to claim 12, further comprising returning the submerged first pushers of the first gathering chain to a starting position and, in the process, moving the submerged first pushers through the recesses in the second gathering chain.

20. A gathering and wire-stitching machine comprising the device according to claim 1.

21. The device according to claim 1, wherein the recess has a length, extending in the conveying direction, which is selected so that each first pusher of the first gathering chain can be submerged completely without hitting the second gathering chain.

* * * * *